US008937551B2

(12) United States Patent
Daniel

(10) Patent No.: US 8,937,551 B2
(45) Date of Patent: Jan. 20, 2015

(54) COVERT SECURITY ALARM SYSTEM

(76) Inventor: Isaac S. Daniel, Miramar, FL (US)

( * ) Notice: Subject to any disclaimer, the term of this patent is extended or adjusted under 35 U.S.C. 154(b) by 383 days.

(21) Appl. No.: 13/247,988

(22) Filed: Sep. 28, 2011

(65) Prior Publication Data

US 2012/0081229 A1 Apr. 5, 2012

Related U.S. Application Data

(60) Provisional application No. 61/387,341, filed on Sep. 28, 2010.

(51) Int. Cl.
*G08B 23/00* (2006.01)
*G08B 13/196* (2006.01)

(52) U.S. Cl.
CPC ..... *G08B 13/19615* (2013.01)
USPC ..... 340/573.1

(58) Field of Classification Search
USPC ..... 340/573.1, 506, 541, 539.14; 715/863
See application file for complete search history.

(56) References Cited

U.S. PATENT DOCUMENTS 5,793,409 A 8/1998 Tetsumura
6,950,534 B2 9/2005 Cohen et al.
7,134,130 B1 11/2006 Thomas
8,078,290 B2 12/2011 Nelson
8,457,353 B2 * 6/2013 Reville et al. ..... 382/103
2003/0076293 A1 * 4/2003 Mattsson ..... 345/156
2004/0135885 A1 * 7/2004 Hage ..... 348/143
2004/0222047 A1 11/2004 Difranza et al.
2006/0136962 A1 6/2006 Masaki
2007/0085690 A1 * 4/2007 Tran ..... 340/573.1
2008/0046930 A1 2/2008 Smith
2008/0134102 A1 * 6/2008 Movold et al. ..... 715/863
2008/0244639 A1 10/2008 Kaaz
2009/0079813 A1 3/2009 Hildreth
2009/0092284 A1 4/2009 Breed et al.
2010/0185341 A1 7/2010 Wilson et al.
2011/0046920 A1 * 2/2011 Amis ..... 702/181

OTHER PUBLICATIONS

PCT International Search Report, PCT/US2011/020869, mailed Jul. 18, 2011, 5 pages, European Patent Office, International Searching Authority.

* cited by examiner

*Primary Examiner* — Phung Nguyen
(74) *Attorney, Agent, or Firm* — Carol N. Green Kaul, Esq.

(57) ABSTRACT

A system for covertly activating an alarm comprising: at least one processor; at least one covert 3D sensor; and computer executable instructions readable by the at least one processor and operative to: use the at least one covert 3D sensor in conjunction with gesture recognition software to sense at least one covert gesture made by at least one person in a space; and covertly trigger an alarm based on the at least one covert gesture.

17 Claims, 5 Drawing Sheets

COVERT SECURITY ALARM SYSTEM

PRIORITY CLAIM

The present application is a non-provisional of U.S. provisional patent application Ser. No. 61/387,341, titled "Covert Security Alarm System," filed on Sep. 28, 2010, by Isaac S. Daniel, to which priority is claimed, and which is hereby incorporated by reference in its entirety as if fully stated herein.

FIELD

The present disclosure relates generally to electronic systems, and more particularly, to systems, methods, and various other disclosures related to covertly triggering security systems.

BACKGROUND

Traditionally, the triggering of a security system, such as personal or commercial security systems, have been based on panic buttons or holdup alarms, such as when a security system is triggered because a person, the victim, believes to be in threat of or in the presence of criminal activity. More sophisticated security systems have allowed such a trigger to occur covertly or unbeknownst to the criminal threat. Despite the existence of such security systems, criminals have been able to prevent the trigger, detect the triggering of the alarm, detect the alarm itself, or neutralize the triggered alarm.

SUMMARY

The various embodiments of systems and methods disclosed herein result from the realization that a security system alarm could be triggered covertly by one or more physical gestures, by the victim, by providing a system and method for determining the meaning of a specific gesture or series of gestures detected by a sensor capable of detecting three-dimensional movement in a given area.

DETAILED DESCRIPTION OF PREFERRED EMBODIMENTS

System and Method Level Overview

Figure 1A:
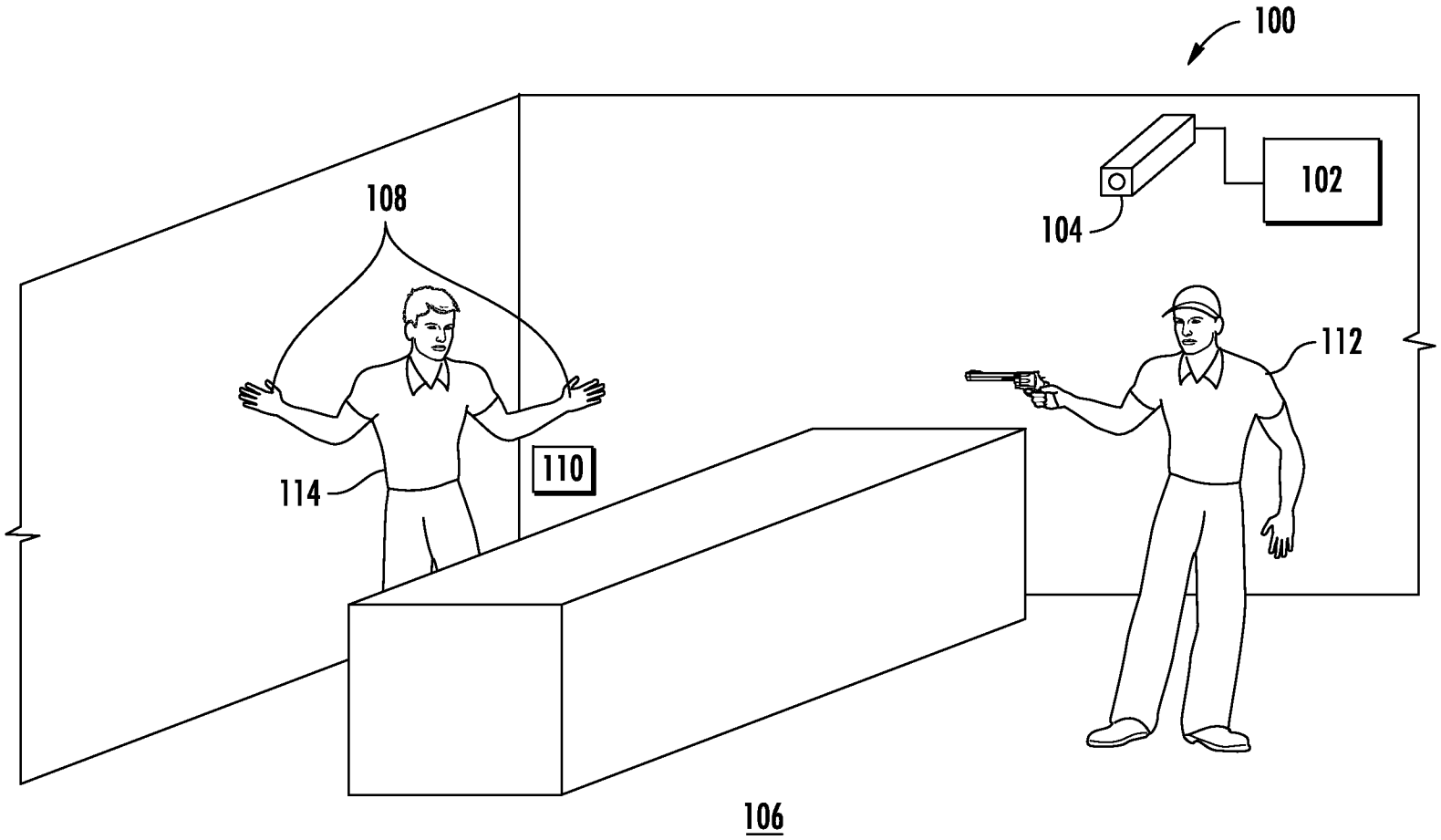
FIG. 1A provides an embodiment of a covert security alarm system.

FIG. 1A shows a system 100 in accordance with some embodiments. In one embodiment, system 100 comprises at least one processor 102, at least one covert sensor 104, wherein the at least one sensor 104 may be electronically connected or wirelessly connected to the at least one processor 102, and computer executable instructions (not shown) readable by the at least one processor 102 and operative to use the at least one sensor 104 to identify at least one gesture 108 by a person 114, and trigger or deactivate a covert security alarm based on the at least one gesture 108 unbeknownst to a second person 112. The persons or the person 114 making the at least one gesture 108 may be in a space 106, such as, but not limited to, a room in a residence, a room in a commercial space, and the like. In one embodiment the second person 112 would be a criminal threat to the gesture making person 114.

The terms "electronically connected," "electronic connection," and the like, as used throughout the present disclosure, are intended to describe any kind of electronic connection or electronic communication, such as, but not limited to, a physically connected or wired electronic connection and/or a wireless electronic connection.

In some embodiments, the at least one processor 102 may be any kind of processor, including, but not limited to, a single core processor, a multi core processor, a video processor, and the like.

At least one sensor 104 may be any kind of sensor, such as, but not limited to, a camera, an infrared camera, a thermal imaging camera, a video sensor, a digital camera, a three-dimensional (3D) camera or sensor, a microphone, a room occupancy sensor, a tactile sensor, such as a vibration sensor, a chemical sensor, such as an odor sensor, an electrical sensor, such as a capacitive sensor, a resistive sensor, and a thermal sensor, such as a heat sensor and/or infrared camera, and the like. In some embodiments, the sensor 104 may be any type of 3D sensor and/or camera, such as a time of flight camera, a structured light camera, a modulated light camera, a triangulation camera, and the like, including, but not limited to, those cameras developed and manufactured by PMDTechnologies, GmbH, Am Eichenhang 50, D-57076 Siegen, Germany; Canesta, Inc., 1156 Sonora Court, Sunnyvale, Calif., 94086, USA; Optrima, NV, Witherenstraat 4, 1040 Brussels, Belgium; Primesense, of Israel; and the Bidirectional Screen developed by the Massachusetts Institute of Technology.

The computer executable instructions may be loaded directly on the processor, or may be stored in a storage means, such as, but not limited to, computer readable media, such as, but not limited to, a hard drive, a solid state drive, a flash memory, random access memory, CD-ROM, CD-R, CD-RW, DVD-ROM, DVD-R, DVD-RW, and the like. The computer executable instructions may be any type of computer executable instructions, which may be in the form of a computer program, the program being composed in any suitable programming language or source code, such as C++, C, JAVA, JavaScript, HTML, XML, and other programming languages.

In one embodiment, the computer executable instructions may include object recognition software and/or firmware, which may be used to identify the at least one gesture 108 made. Such object recognition software may include image recognition software, which may, in turn, include facial recognition software, or may simply include general visual object recognition software. In another embodiment, the object recognition software may be audio based, being able to distinguish objects (e.g. persons) that are producing certain audio (such as breathing, talking, etc.). In yet a further embodiment, the object recognition software may use a plurality of at least one sensors to identify the at least one gesture 108.

The terms "object recognition software," "facial recognition software," and "image recognition software," as used throughout the present disclosure, may refer to the various embodiments of object recognition software known in the art, including, but not limited to, those embodiments described in the following publications: *Reliable Face Recognition Methods: System Design, Implementation, and Evaluation*, by Harry Wechsler, Copyright 2007, Published by Springer, ISBN-13: 978-0-387-22372-8; *Biometric Technologies and Verification Systems*, by John Vacca, Copyright 2007, Elsevier, Inc., Published by Butterworth-Heinemann, ISBN-13: 978-0-7506-7967-1; and *Image Analysis and Recognition*, edited by Aurelio Campilho and Mohamed Kamel, Copyright 2008, Published by Springer, ISBN-13: 978-3-540-69811-1, *Eye Tracking Methodology: Theory and Practice*, by Andrew T. Duchowski, Copyright 2007, Published by Springer, ISBN 978-1-84628-608-7, all of which are herein incorporated by reference. In one embodiment, the object recognition software may comprise 3D sensor middleware, which may include 3D gesture control and/or object recognition middle ware, such as those various embodiments produced and developed by Softkinetic S.A., 24 Avenue L. Mommaerts, Brussels, B-1140, Belgium, Microsoft Corp., One Microsoft Way, Redmond, Wash., USA, and Omek Interactive, 2 Hahar Street, Industrial Zone Har Tuv A, Ganir Center Beith Shemesh 99067, Israel.

In one embodiment the at least one gesture 108 may comprise any kind of physical gesture made by a person 114, such as movement of the extremities, the limbs, the fingers, and the like. In another embodiment the at least one gesture 108 may comprise the actions a combination of movements of the limbs, such as the physical gesture of a person 114 patting their head. In another embodiment the at least one 108 gesture may comprise the actions of rubbing their stomach in a circular motion. In another embodiment the at least one gesture 108 may comprise more than one action, such as patting one's head at the same times as rubbing one's stomach in a circular motion. In yet another embodiment the at least one gesture 108 may comprise the actions of placing both hands in the air (as shown). In some embodiments the at least one gesture can be comprised of any physical gesture or series of physical gestures capable of being recognized by the covert security alarm system. In some embodiments more than one gesture or series of gestures may be recognized and used to either trigger or deactivate the covert security alarm system. In some embodiments the at least one gesture 108 may be distinguishable from other similar or the same gestures by time and/or place in the space 106. In a further embodiment, at least one gesture 108 may comprise a covert gesture, such as one not easily noticed or recognized by a lay person.

In some embodiments, the computer executable instructions may be further operative to compare the at least one gesture 108 with a gesture or series of gestures that are meaningless, such as those gestures that might ordinarily be performed in a space 106. In some embodiments, the computer data defining the at least one gesture 108 may be contained in a database. In other embodiments, the computer data defining the at least one gesture 108 may be received from a remote station, such as a security monitoring station, in communication with system 100. In yet other embodiments, the computer data defining the at least one gesture 108 may be contained on a piece of media hardware, such as a DVD, CD, and the like.

In a further embodiment, system 100 comprises at least one means for communication with a local device, wherein the means for communicating with the local device may be electronically connected to the at least one processor 102. In some embodiments, such means may include a Bluetooth module, a USB port, an infrared port, a network adapter, such as a Wi-Fi card, and the like. The local device may be any kind of device, such as a television, a computer, a remote control, a telephone, a portable digital assistant, and the like.

In a further embodiment, the computer executable instructions may be operative to trigger an alarm if the at least one gesture 108 is recognized as a predetermined gesture or series of gestures. In some embodiments, the alarm may be a local alarm, such as an audible alarm capable of being perceived by the persons 114 making the at least one gesture 108. In another embodiment, the alarm may be a covert holdup alarm, not capable of being noticed or detected by those persons or person 112 not making the gesture in the space 106, such as a remote alarm to local law enforcement. In yet another embodiment, the alarm may be a remote alarm, such as an alert sent by system 100 to a remote user, wherein the alert may be any kind of alert, including, but not limited to, an e-mail, and SMS message, a phone call, and the like.

In yet another embodiment, system 100 further comprises at least one means for communicating with a remote station, wherein the means for communicating may be electronically connected to the at least one processor 102. In some embodiments, the means for communicating with a remote station may be any kind of means, such as, but not limited to, a wireless modem, such as a GSM modem, a wired modem, an Ethernet adapter, a Wi-Fi adapter, and the like. In some embodiments, the remote station may be a security service provider, or a remote communications device, such as, but not limited to, a cellular phone, a phone, a computer, and the like. In such embodiments, the computer executable instructions may be further operative to use the at least one means for communicating with a remote station to transmit or receive information to or from the remote station. The information may include the computer data definition of the at least one gesture 108 and subsequent computer executable instructions, billing information, and software updates. In some embodiments, a user, such as a person, may use system 100 to select and/or download the content, or select the at least one gesture 108 to be recognized.

In one embodiment, system 100 may be positioned on or near a display device 110, such as a television or computer monitor. In other embodiments, system 100 may be positioned within, or integrated with a display device (not shown), such as a television, tablet computer, personal computer, laptop computer, and the like.

In some embodiments, system 100 may further comprise a means for receiving input, which in some embodiments, may be any type of means, including, but not limited to: a telephone modem: a key pad, a key board, a remote control, a touch screen, a virtual keyboard, a mouse, a stylus, a microphone, a camera, a fingerprint scanner, and a retinal scanner. In a further embodiment, system 100 may include a biometric identification means to identify a person, such as a fingerprint scanner, an eye scanner, and facial recognition software.

In another embodiment, the computer executable instructions may be operative to allow for the modification of the automated response to the at least one gesture 108. In one embodiment, the at least one gesture 108 may prompt a computer automated action, such as the dimming of lights, the locking of doors, and the like. Such an operation may be accomplished by bringing up an electronic menu on a display device, such as a personal computer, a personal communications device, such as a cellular phone, and the like, that prompts a person to define the response to the at least one gesture 108 or to modify the response to the at least one gesture 108. Alternatively, the computer executable instructions may be operative to allow a person to delete the response to the at least one gesture 108, or to change the at least one gesture 108 to a given response.

Figure 1B:
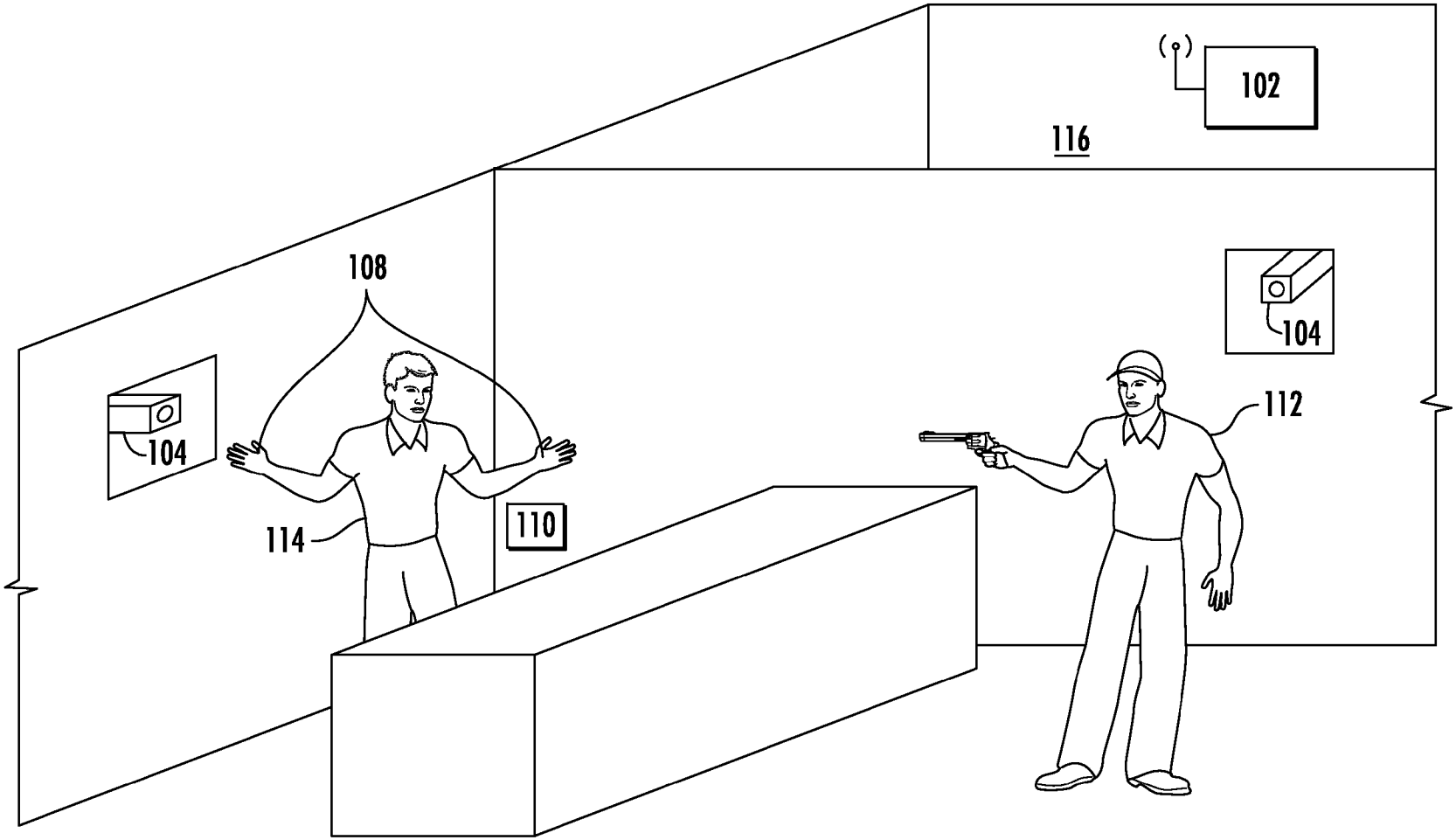
FIG. 1B provides another embodiment of a covert security alarm system.

In one embodiment, as shown in FIG. 1A, system 100 may be positioned on, in, or near a space 106, such as a room in personal residence or a commercial place of business, and the like. In another embodiment as shown in FIG. 1B, a covert security system, comprising the hardware components at least one sensor 104 and at least one process 102, may be positioned covertly unbeknownst to unwanted persons 114. This may include hiding a covert security system in covert places, such as within the walls of space 106, in an adjacent room to space 106, contained within a traditional electrical fixture, behind a surface such as a two way mirror, and the like. In one embodiment the at least one sensor 104 of a covert security system may be covertly hidden, such as behind a piece of furniture, within a piece of furniture, within an electrical fixture, behind at least one two way mirror (as shown in FIG. 1B), recessed in a vent, and the like. In one embodiment the at least one processor 102 may be covertly hidden, such as in another room 116 (as shown in FIG. 1B), at a remote location, concealed in a wall, and the like. In one embodiment, as shown in FIG. 1B, components of system 100 may be covertly hidden independently of each other, such as hiding the at least one sensor 104 behind a two-way mirror separate but electronically connected to the at least one processor 102 in an adjacent room.

In a further embodiment, system 100 may comprise at least one means for monitoring a space 106, such as the use of at least one sensor for detecting any physical gesture. At least one means for identifying at least one gesture 108, may include any kind of means for identifying a person, such as a human movement recognition software analyzing and interpreting data from an at least one sensor 104, such as a 3D camera. At least one means for identifying a person may be electronically connected to and/or in electronic communication with at least one processor 102, and/or at least one sensor 104.

In yet a further embodiment, system 100 may comprise at least one means for restricting access or granting access to a space 106 that is being monitored, wherein the restriction may be based on the at least one gesture being made in the space 106 being monitored. The means for restricting or granting access may be any kind of means for the control of an access point, such as a door, a lock, a turn style, a limited access elevator, a security guard, and the like. In some embodiments, at least one means for restricting access to space 106 may be electronically connected to and/or in electronic communication with at least one processor 102, and/or at least one sensor 104.

Figure 2:
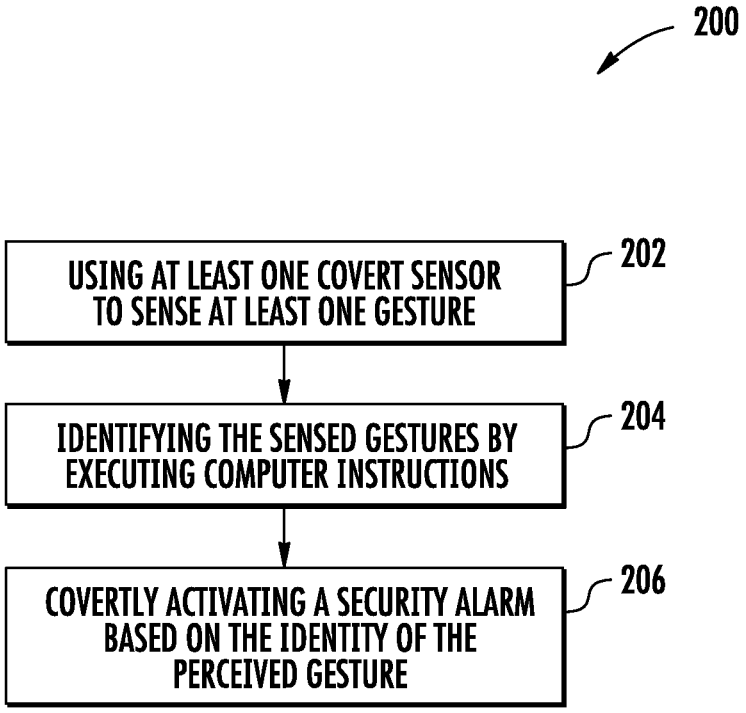
FIG. 2 provides an embodiment of the method of operation of a covert security alarm system.

FIG. 2 shows one embodiment of a method 200 by which a covert security alarm system may operate, comprising the steps of using at least one cover sensor to sense at least one gesture 202; identifying the sensed gestures by executing computer executable instructions 204; and covertly activating a security alarm system covertly based on the identity of the perceived gesture 206. In a further embodiment, method 200 comprises the steps of transmitting the information gathered by the sensor to the processor. In a further embodiment, method 200 comprises the step of processing the information gathered by the sensor according to computer instructions. In a further embodiment, method 200 comprises the steps of deactivating a security alarm system based on the identity of a perceived gesture. In a further embodiment, method 200 comprises the step of notifying a remote agent, such as alerting local law enforcement, sending an SMS to a security guard, and the like.

Throughout the present disclosure, it should be understood that computer executable instructions, such as those in system 100, may be used to manipulate and use the various embodiments of systems and components thereof, such as the at least one processor, at least one sensor 104, the at least one means for identifying the at least one gesture 108, and/or the at least one means for restricting access.

Figure 3:
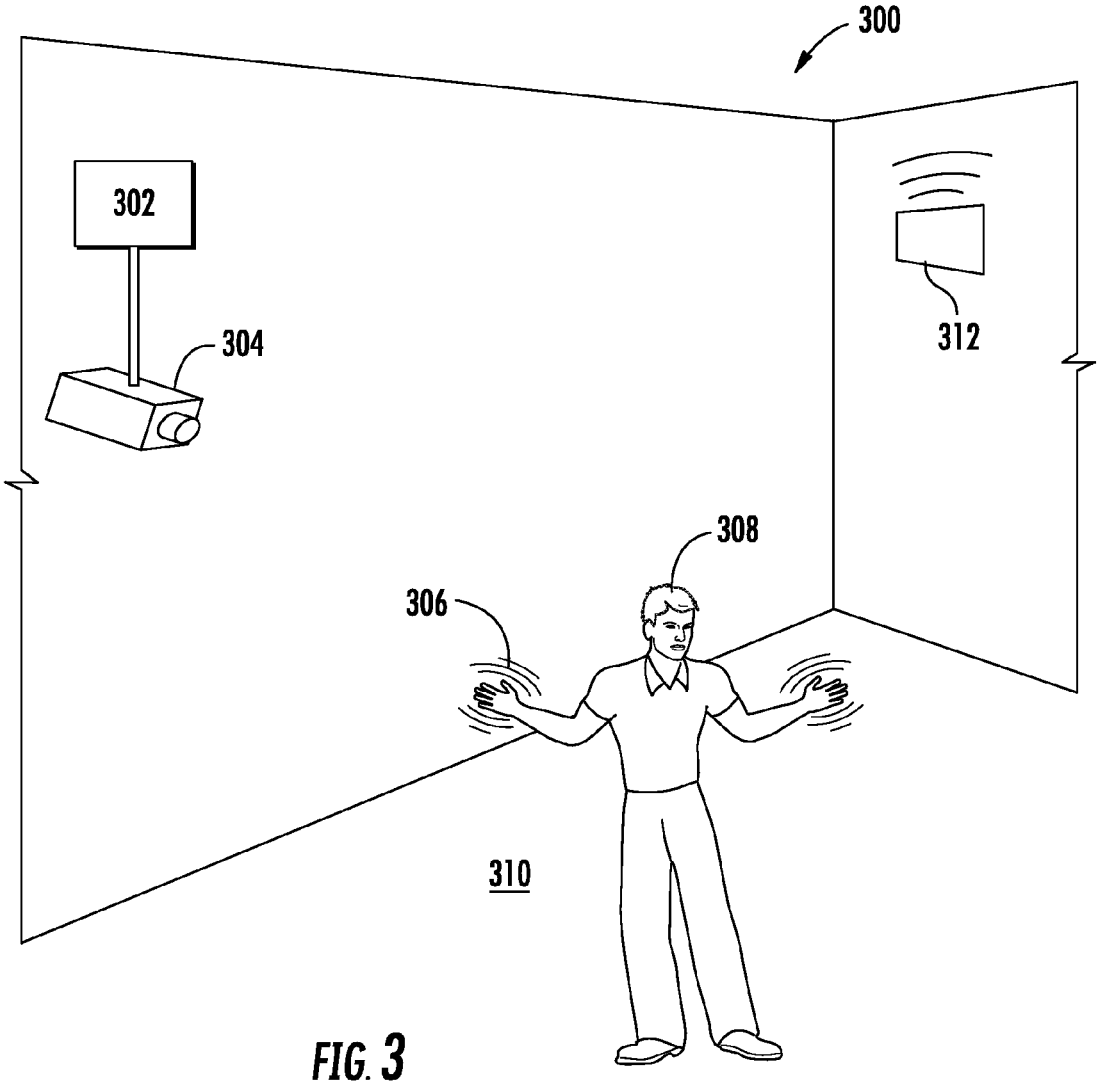
FIG. 3 shows a system in accordance with one embodiment.

Referring now to FIG. 3, a system 300 for covertly activating an alarm is shown in accordance with one embodiment, wherein system 300 comprises at least one processor 302, at least one covert 3D sensor 304, and computer executable instructions readable by the at least one processor 302 and operative to use the at least one covert 3D 304 sensor in conjunction with gesture recognition software (not shown) to sense at least one covert gesture 306 made by at least one person 308 in a space 310, and covertly trigger an alarm 312 based on the at least one covert gesture 306.

At least one processor 302 may be any type of processor, such as those embodiments described herein with reference to FIGS. 1A, 1B, 2, and 4.

At least one covert 3D sensor may be any type of 3D sensor, such as those described herein with reference to FIGS. 1A, 1B, and 2 and elsewhere throughout the present disclosure.

The gesture recognition software may be any of those embodiments described above with reference to FIGS. 1A, 1B, and 2, and elsewhere throughout the present disclosure.

At least one gesture 306 may be any type of gesture, such as those described herein with reference to FIGS. 1A, 1B, and 2 and elsewhere throughout the present disclosure.

Person 308 may be any type of person, such as those described herein with reference to FIGS. 1A, 1B, and 2 and elsewhere throughout the present disclosure.

Space 310, may be any indoor or outdoor space, such as rooms, halls, patios, yards, fields, and the like. Space 310 may further comprise any of those embodiments described herein throughout the present disclosure.

Alarm 312 may be any type of alarm, such as those described herein with reference to FIGS. 1A, 1B, and 2 and elsewhere throughout the present disclosure.

All of the above mentioned embodiments may be carried out using a method, whose steps have been described above and elsewhere throughout the present disclosure.

Hardware and Operating Environment

This section provides an overview of example hardware and the operating environments in conjunction with which embodiments of the inventive subject matter may be implemented.

A software program may be launched from a computer readable medium in a computer-based system to execute functions defined in the software program. Various programming languages may be employed to create software programs designed to implement and perform the methods disclosed herein. The programs may be structured in an object-orientated format using an object-oriented language such as Java or C++. Alternatively the programs may be structured in a procedure-oriented format using a procedural language, such as assembly or C. The software components may communicate using a number of mechanisms, such as application program interfaces, or inter-process communication techniques, including remote procedure calls. The teachings of various embodiments are not limited to any particular programming language or environment. Thus, other embodiments may be realized, as discussed regarding FIG. 4 below.

Figure 4:
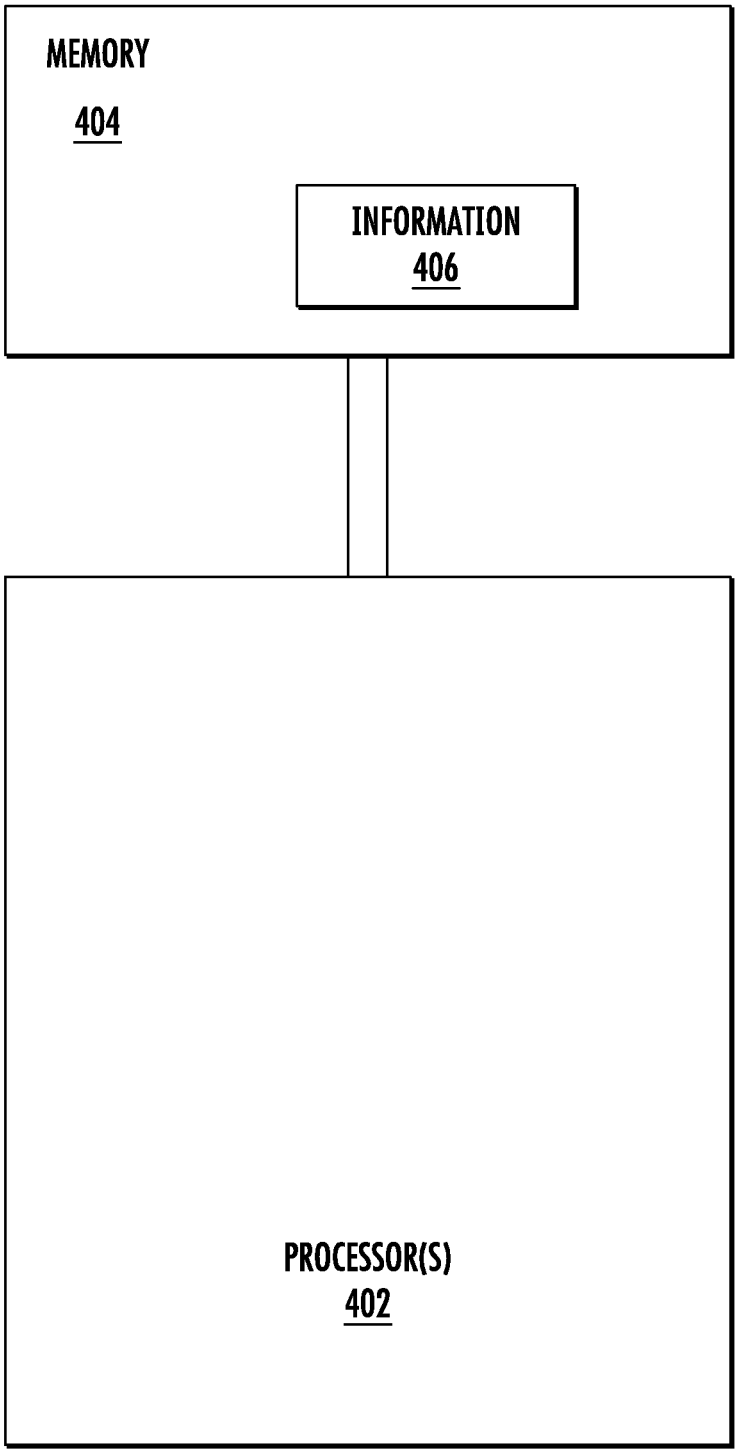
FIG. 4 shows an article in accordance with one embodiment.

FIG. 4 is a block diagram representing an article according to various embodiments. Such embodiments may comprise a computer, a memory system, a magnetic or optical disk, some other storage device, or any type of electronic device or system. The article 400 may include one or more processor(s) 402 coupled to a machine-accessible medium such as a memory 404 (e.g., a memory including electrical, optical, or electromagnetic elements). The medium may contain associated information 406 (e.g., computer program instructions, data, or both) which, when accessed, results in a machine (e.g., the processor(s) 402) performing the activities previously described herein.

The principles of the present disclosure may be applied to all types of computers, systems, and the like, include desktop computers, servers, notebook computers, personal digital assistants, and the like. However, the present disclosure may not be limited to the personal computer.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A system comprising:

a. at least one processor;

b. at least one covert sensor; and c. computer executable instructions readable by the at least one processor and operative to:

i. use the at least one covert sensor to identify at least one covert gesture or series of gestures; and ii. covertly trigger an alarm based on the at least one covert gesture or series of gestures, wherein the computer executable instructions are further operative to deactivate an alarm covertly based on the at least one gesture or series of gestures in a space.

2. The system of claim 1, wherein the at least one covert gesture or series of gestures comprises the action of placing both hands in the air.

3. The system of claim 1, wherein the computer executable instructions are operative to distinguish the at least one covert gesture or series of gestures from other similar or same gestures by at least one of a time and a place in a space where the at least one covert gesture or series of gestures is performed.

4. The system of claim 1, wherein the alarm comprises a covert hold up alarm.

5. The system of claim 1, wherein the computer executable instructions are operative to compare the at least one covert gesture or series of gestures with a gesture or series of gestures that are meaningless.

6. The system of claim 5, wherein the gesture or series of gestures that are meaningless comprises gestures that are ordinarily performed in a space.

7. The system of claim 1, wherein the computer executable instructions are operative to allow a user to perform at least one of the following:

a. select the at least one covert gesture or series of gestures to be recognized;

b. define or modify a response to the at least one covert gesture or series of gestures; and c. define or modify a gesture associated with a response.

8. The system of claim 1, wherein the at least one sensor is at least one three-dimensional sensor.

9. The system of claim 1, wherein the at least one sensor comprises a 3D camera.

10. A method of covertly activating a security alarm system comprising the steps of:

a. using at least one covert sensor to sense at least one covert gesture;

b. identifying the sensed covert gesture by executing computer instructions;

c. covertly activating a security alarm system based on the identity of the identified covert gesture; and d. distinguishing the covert gesture from other similar or same gestures by at least one of a time and a place in a space where the covert gestures is performed.

11. The method of claim 10, further comprising comparing the covert gestures with a gesture that is meaningless.

12. A system for covertly activating an alarm comprising:

a. at least one processor;

b. at least one covert 3D sensor; and c. computer executable instructions readable by the at least one processor and operative to:

i. use the at least one covert 3D sensor in conjunction with gesture recognition software to sense at least one covert gesture made by at least one person in a space; and ii. covertly trigger an alarm based on the at least one covert gesture, wherein the computer executable instructions are operative to distinguish the at least one covert gesture from other similar or same gestures by at least one of a time and a place in the space where the at least one covert gesture is performed.

13. The system of claim 12, wherein the at least one covert gesture comprises the action of the at least one person placing both their hands in the air.

14. The system of claim 12, wherein the computer executable instructions are operative to compare the at least one covert gesture with a gesture or series of gestures that are meaningless.

15. The system of claim 14, wherein the gesture or series of gestures that are meaningless comprises gestures that are ordinarily performed in the space.

16. The system of claim 12, wherein the alarm comprises a cover hold up alarm.

17. The system of claim 12, wherein the computer executable instructions are operative to allow a user to perform at least one of the following:

a. select the at least one covert gesture to be recognized;

b. define or modify a response to the at least one covert gesture; and c. define or modify a gesture associated with a response.

* * * * *